US005802884A

United States Patent [19]

Cavalli

[11] Patent Number: 5,802,884

[45] Date of Patent: Sep. 8, 1998

[54] MACHINE FOR WASHING AND DEGREASING WITH SOLVENTS OR FOR DRYING TEXTILE PRODUCTS OR THE LIKE

[76] Inventor: Giuseppe Cavalli, Viale Matteo, 8 - 22060 Campione D'Italia (Prov. di Como), Italy

[21] Appl. No.: 742,616

[22] Filed: Nov. 1, 1996

[51] Int. Cl.[6] ..... D06F 43/08; F26B 21/02

[52] U.S. Cl. ..... 68/18 C; 68/20; 34/609

[58] Field of Search ..... 68/20, 18 C, 18 R, 68/19.2; 34/604, 606, 609, 610

[56] References Cited

U.S. PATENT DOCUMENTS

| | | | |
|---|---|---|---|
| 2,568,068 | 9/1951 | Harpman | 317/2 R |
| 2,908,086 | 10/1959 | Fuhring | 34/604 |
| 2,942,353 | 6/1960 | Barnett | 34/604 |
| 3,401,052 | 9/1968 | Berger et al. | 68/20 |
| 3,722,106 | 3/1973 | Takeyama et al. | 34/604 |
| 3,807,948 | 4/1974 | Moore | 68/18 C |
| 3,841,117 | 10/1974 | Crivilles | 68/20 |
| 3,991,479 | 11/1976 | Dionne | 34/248 |
| 5,357,771 | 10/1994 | Schaal | 68/20 |

*Primary Examiner*—Amy B. Vanatta
*Attorney, Agent, or Firm*—Guido Modiano; Albert Josif

[57] ABSTRACT

A machine for washing and degreasing with solvents or for drying textile products or the like, including a container that accommodates a drum that can be rotated about its own axis. The container is closed by a door on one of its sides, which is directed towards an axial end of the drum, and a circuit is provided for conveying a stream of drying air, the circuit having a delivery duct leading into the container at the region of the door. The machine comprises a chamber for directing the stream of drying air, in the region where it enters the container, along a direction that is substantially parallel to the axis of the drum.

8 Claims, 3 Drawing Sheets

MACHINE FOR WASHING AND DEGREASING WITH SOLVENTS OR FOR DRYING TEXTILE PRODUCTS OR THE LIKE

BACKGROUND OF THE INVENTION

The present invention relates to a machine for washing and degreasing with solvents or for drying textile products or the like.

Conventional machines for washing and degreasing textile products or the like with solvents generally comprise a fixed container or vat, usually substantially cylindrical and arranged so that its axis is horizontal, inside which a drum is arranged which is actuatable with rotary motion about its own axis, said axis being usually parallel to the axis of the container.

The drum is open at one of its flat faces and has a plurality of perforations on its lateral surface. The container, at the open axial end of the drum, is provided with a door that can be opened to load or unload the products to be washed.

During washing, the drum is rotated about its axis, so as to move the products being washed in the solvent introduced in the vat.

After washing, the solvents are removed from the vat and the washed products are dried by introducing a stream of preheated air in the vat.

More specifically, these machines generally have a circuit for conveying a stream of drying air, which has a delivery duct that leads into the vat at the door region. A condensation device is provided along said circuit and is constituted by a heat exchanger, through which the stream of air that leaves the vat is cooled so as to cause the condensation of the solvent vapors removed by the stream of air and thus separate them from the air, which is then heated, for example by means of electric resistors or other heat exchangers, before being returned into the vat.

The air is circulated along the conveyance circuit by means of one or more fans.

In conventional machines, the outlet of the hot air delivery duct faces the side wall of the door; therefore, the air is throttled and redirected during its introduction in the vat, causing high load losses and preventing, during subsequent introduction in the vat or rather in the drum, all the regions of the drum, inside which the products to be dried are arranged, from being reached.

In order to compensate for the load losses arising from throttling and redirection at the region where the stream of hot air is introduced in the vat, and therefore increase the efficiency of the drying action, fans are generally provided which have a significantly greater head than the theoretical head required to achieve correct circulation of the stream of hot air along the conveyance circuit. This solution increases the speed of the air inside said circuit and thus reduces the effectiveness of the condensation device, causing the problem of returning air and solvent vapors at a high temperature into the vat.

The presence of heated solvents in the stream of air that is fed back into the vat is undesirable, since solvents at high temperature can damage the products being dried. The use of fans with a high head furthermore increases the pressure inside the vat.

With conventional machines it is therefore noted that, during drying, the inside of the vat becomes pressurized and that the stream of hot air fed into said vat contains residual vapors, causing, as a consequence of this fact, the problem of a reduction in the evaporation of the solvents in the products to be dried.

The reduced evaporation and poor efficiency in condensing the solvent vapors leads to an increase in drying times and therefore to an increase in the running costs of these machines.

Similar problems can be observed with rotary-drum machines for drying textile products.

SUMMARY OF THE INVENTION

A principal aim of the present invention is to solve the above problems by providing a machine for washing and degreasing with solvents, or for drying textile products or the like, which is highly effective in drying the products.

Within the scope of this aim, an object of the invention is to provide a machine that allows to significantly reduce the drying times, and therefore the energy costs, during this step.

Another object of the invention is to provide a machine that can operate with a fan for circulating the drying air that has a lower power rating and can thus have lower production and running costs with respect to conventional machines.

Another object of the invention is to provide a machine that allows to achieve a uniform distribution of the drying air inside the drum in which the products to be dried are arranged.

This aim, these objects, and others which will become apparent hereinafter are achieved by a machine for washing and degreasing with solvents or for drying textile products or the like, comprising a container that accommodates a drum that can be rotated about its own axis, said container being closed by a door on one of its sides, which is directed towards an axial end of said drum, a circuit for conveying a stream of drying air being provided, said circuit having a delivery duct leading into said container at the region of said door, wherein the machine comprises means for directing the stream of drying air, in the region where it enters said container, along a direction that is substantially parallel to the axis of said drum.

BRIEF DESCRIPTION OF THE DRAWINGS

Further characteristics and advantages of the invention will become apparent from the following detailed description of a preferred but not exclusive embodiment of the machine according to the invention, illustrated only by way of non-limitative example in the accompanying drawings, wherein.

DESCRIPTION OF THE PREFERRED EMBODIMENTS

Figure 1:
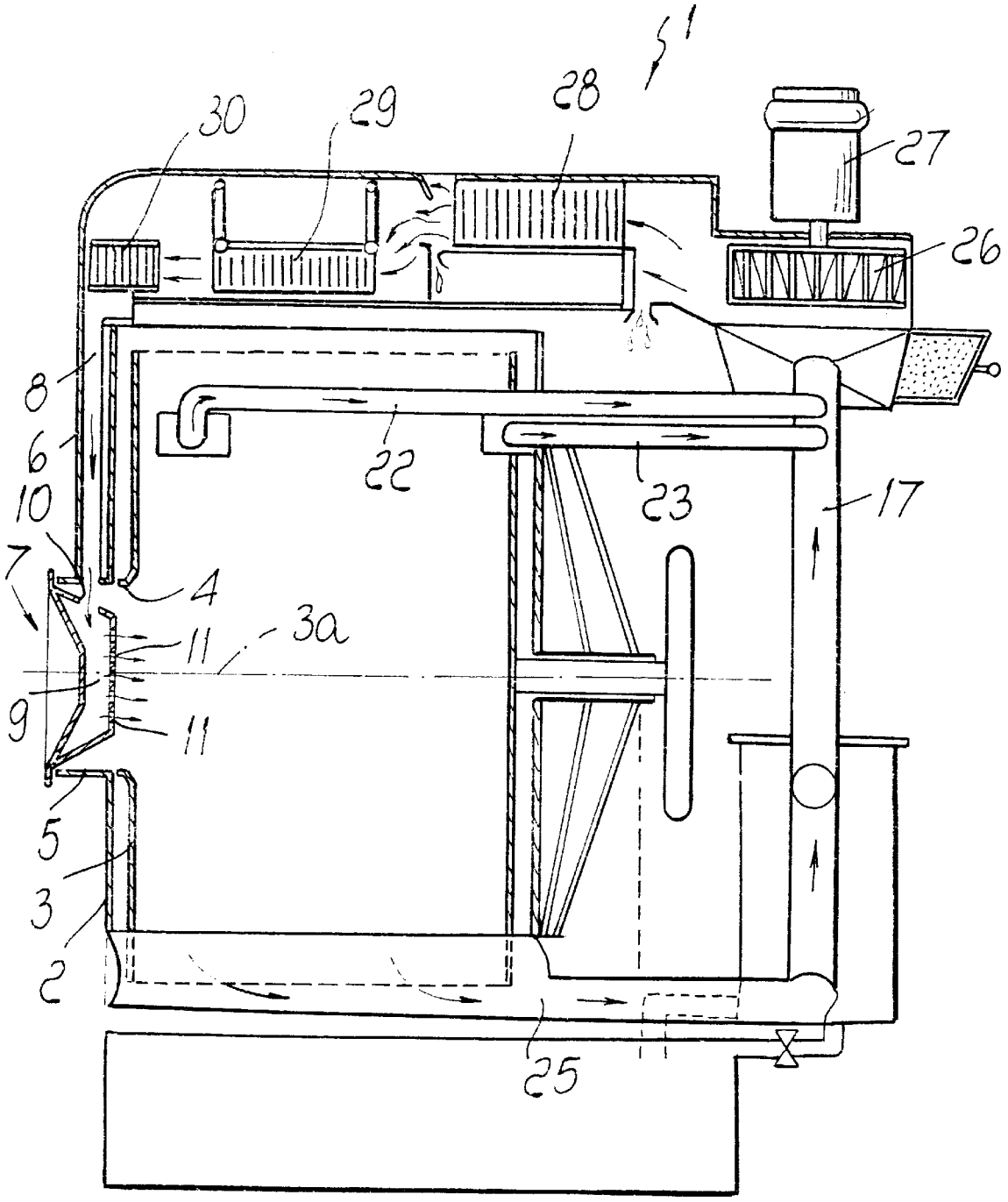
FIG. 1 is a partially sectional and schematic lateral elevation view of the machine according to the invention.
Figure 2:
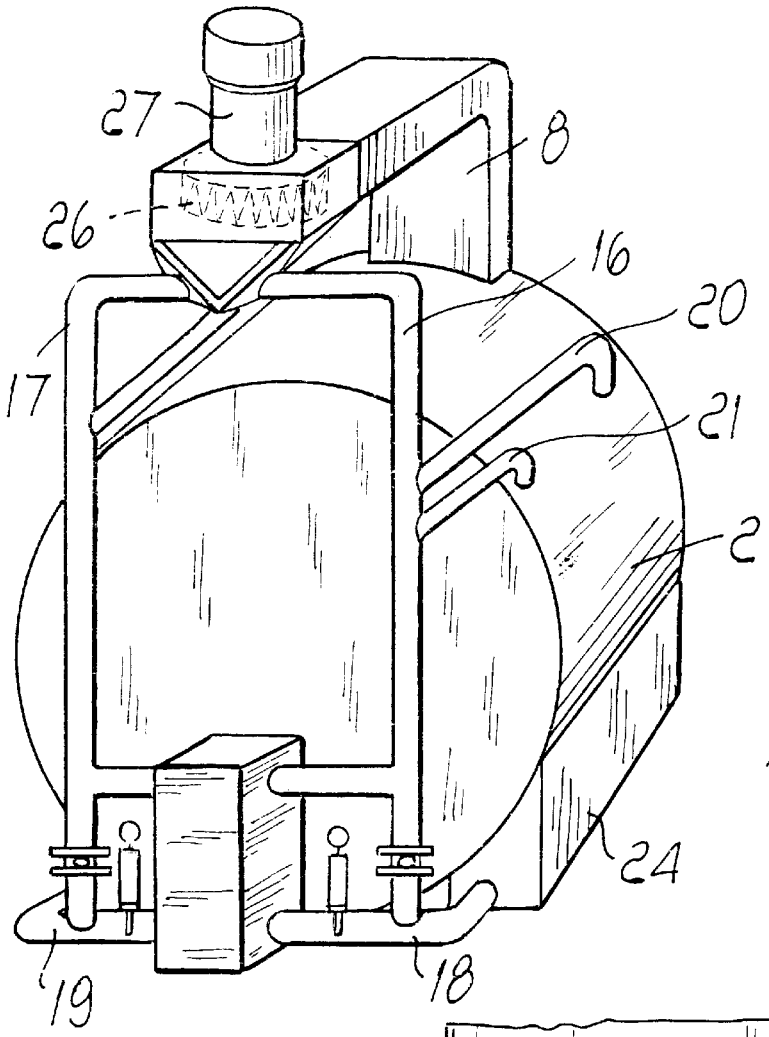
FIG. 2 is a perspective view of the machine according to the invention, taken from the rear side of the container and with the housing removed.
Figure 4:
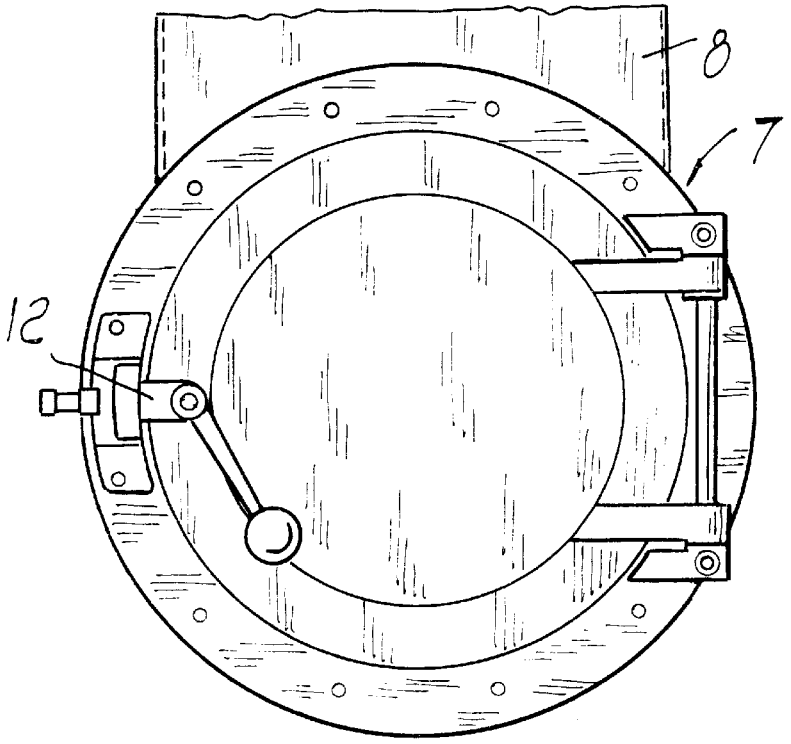
FIG. 4 is a front elevation view of the door of the machine according to the invention.
Figure 3:
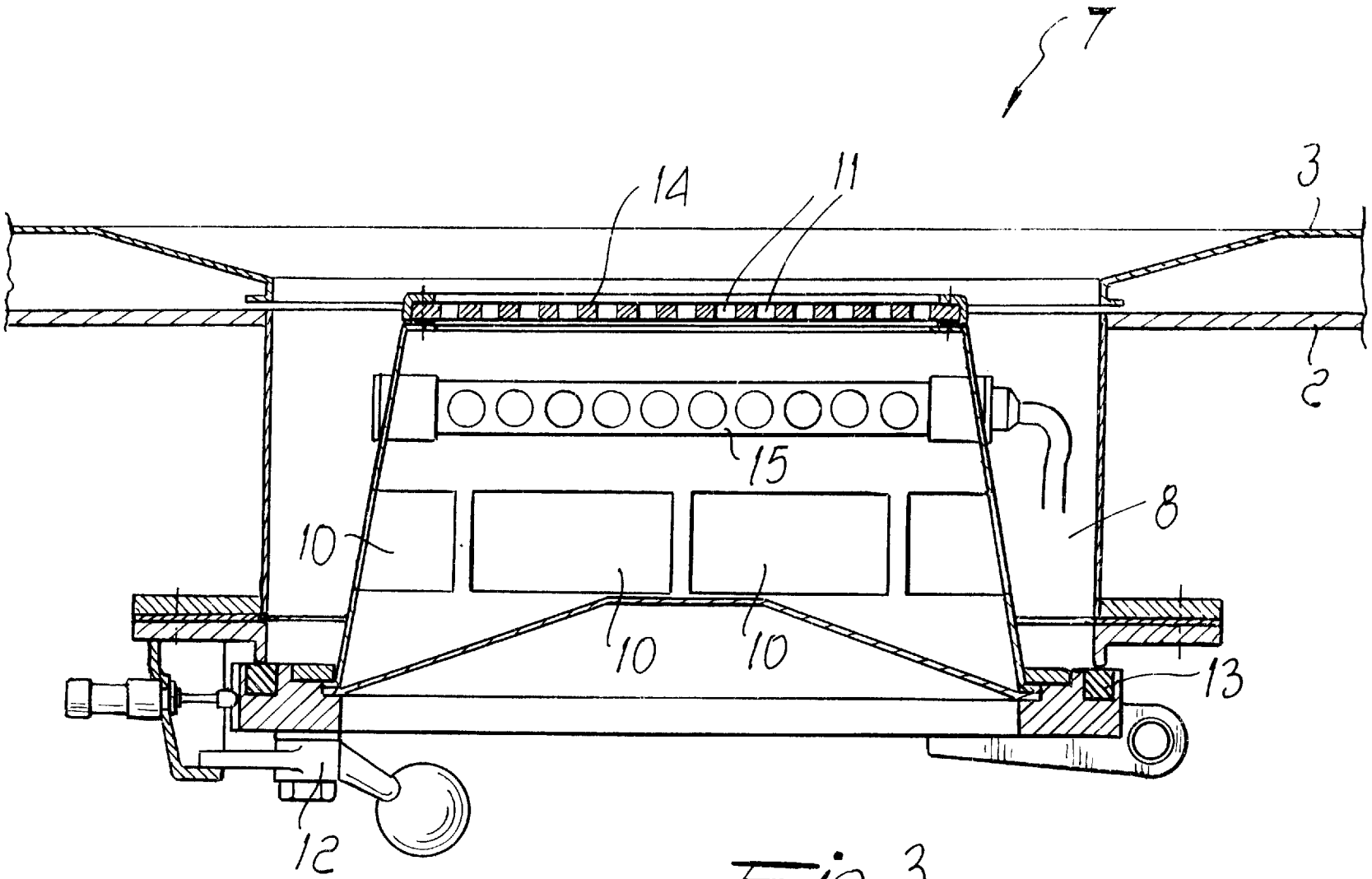
FIG. 3 is a sectional plan view, from below, of the region of the machine according to the invention at the door, taken along a horizontal plane.

With reference to the above figures, the machine according to the invention, generally designated by the reference numeral 1, comprises a fixed container 2 that is preferably substantially cylindrical and is arranged so that its axis is horizontal; a drum 3 is accommodated inside said container and can be rotated, in a per se known manner, about its own axis 3*a*, which is arranged parallel to the axis of the container 2.

The drum 3 has, at one of its flat faces, an opening 4 that lies around the axis 3*a* and faces an opening 5 formed in the front wall 6 of the container 2.

The opening 5 is closed by an openable door that is generally designated by the reference numeral 7 and is arranged coaxially to the drum 3.

The machine according to the invention is also provided with a circuit for conveying a stream of drying air; said circuit has a delivery duct 8 that leads into the container 2 at the region of the door 7.

According to the invention, means are provided for directing the stream of drying air, in the region where it enters the container 2, along a direction that is substantially parallel to the axis 3*a* of the drum 3.

The means for directing the stream of drying air comprise a chamber 9 that is formed in the door 7 and has at least one intake port 10, which is formed on the lateral surface of the door 7 and faces the outlet of the delivery duct 8, and at least one discharge port 11 that is formed on the face of the door 7 that faces the drum 3.

More particularly, the door 7 has a substantially frustum-shaped body, in which the smaller flat face is directed towards the drum 3. The body of the door is hinged, in a per se known manner, to the machine at the opening 5 and is provided with closure means 12 and with sealing gaskets 13 to allow the hermetic closure of the container 2.

A plurality of openings 10 are formed on the lateral surface of the door 7 and affect the lateral surface of the door 7, except for the portion of the lateral surface of the door that lies opposite with respect to the outlet of the delivery duct 8.

The discharge port of the chamber 9 is instead formed by a plurality of holes 11 passing through a glass plate 14 that constitutes the smaller flat face of the body of the door 7.

Conveniently, a conventional anti-static deionizing device 15 is arranged inside the chamber 9 and is adapted to emanate electrostatic charges having the purpose of neutralizing the electrostatic charges that form in the textile products being dried due to the rubbing of the fabric fibers against each other.

The circuit for conveying the drying air comprises, in addition to the delivery duct 8, intake ducts 16 and 17 with branches 18, 19, 20, 21, 22, and 23.

The branches 18 and 19 are connected to two manifolds 24 and 25 that are connected to the container 2 at discharge ports for the drying air, which are located proximate to two lateral lower regions of the container 2.

The branches 20, 21, 22, and 23 are instead connected to outlet ports for the drying air that are formed in upper lateral regions of the container 2.

The drying air is moved along the circuit by means of a fan 26 actuated by an electric motor 27.

Means for condensing the solvent carried by the drying air that leaves the container 2 and means for heating the air before it is fed back into the container 2 are arranged along the drying air circuit in a per se known manner.

The solvent condensing means can be constituted, for example, by a heat exchanger 28 that cools the drying air leaving the container 2, so as to condense the solvent vapors carried by the drying air.

The means for heating the air before returning it inside the container 2 can be constituted, for example, by a heat exchanger 29 and by a superheating exchanger 30 which are arranged in series downstream of the exchanger 28 along the direction of the stream of drying air.

The operation of the machine according to the invention during the drying of the textile products arranged inside the drum 3 is as follows.

The stream of drying air, propelled by the fan 26, that leaves the delivery duct 8 mainly enters the chamber 9 of the door 7, wherefrom it exits through the ports 11, with an orientation that is substantially parallel to the axis 3*a* of the drum 3.

By virtue of this fact, limited load losses are observed when the stream of drying air is introduced in the drum 3; at the same time, a redirection of the drying air stream is achieved that allows the air to reach practically all the regions of the drum and therefore produce an effective evaporation of the solvent that is still present in the products being dried.

The uniform distribution of the stream of drying air inside the drum 3 is also produced by the particular arrangement of the discharge ports of the stream of air, through which the drying air, which carries the solvent vapors, is conveyed through the exchanger 28, which reduces and separates the solvent vapors. The drying air is then heated by passing through the exchangers 29 and 30 and is then fed back into the drum 3.

By virtue of the fact that low load losses occur when the stream of drying air is introduced in the drum 3, and by virtue of the fact that a uniform distribution of the stream of drying air inside the drum 3 is also achieved, it is possible to achieve high drying effectiveness even with drying air speeds that are considerably lower than the speeds that can be observed in conventional machines. As a consequence thereof, higher efficiency of the exchanger 28 is achieved with greater effectiveness in the reduction of vapors and therefore greater overall effectiveness in drying, which allows to significantly reduce the overall drying times.

During drying, by virtue of the presence of the anti-static deionizing device 15, the stream of drying air carries electrostatic charges that eliminate the electrostatic charges being formed in textile products during drying. Therefore, differently from conventional machines, discomfort for the operator who must handle said products is avoided and migrations of dust particles, which would lead to the deposition of unwanted materials on the textile products, compromising their appearance and shades of color, are also avoided.

In practice it has been observed that the machine according to the invention fully achieves the intended aim, since it allows to significantly reduce drying times, allowing savings from the energy point of view and improvements as regards the aesthetic appearance of the dried products.

The improved efficiency in reducing solvent vapors also allows a substantially complete recovery of the solvent residues, furthermore avoiding damage to the dried products.

Although the basic concept of the invention has been described with particular reference to a machine for washing and degreasing textile products or the like by means of solvents, it may nonetheless also be used in rotary-drum drying machines.

The machine thus conceived is susceptible of numerous modifications and variations, all of which are within the scope of the inventive concept; all the details may furthermore be replaced with other technically equivalent elements.

In practice, the materials employed, so long as they are compatible with the specific use, as well as the dimensions, may be any according to the requirements and the state of the art.

What is claimed is:

1. A machine for washing and degreasing with solvents textile products, comprising a container having a drum therein which can be rotated about its own axis, said container being closed by a door on one of its sides, which is directed towards an axial end of said drum, a circuit for conveying a stream of drying air being provided, said circuit having a delivery duct leading into said container at the region of said door, wherein the machine further comprises means for directing the stream of drying air, in the region where it enters said container, along a direction that is substantially parallel to the axis of said drum;

said means for directing the stream of drying air comprising a chamber formed in said door, said chamber being provided with at least one intake port, which is formed on the lateral surface of said door and faces the outlet of said delivery duct, and with at least one discharge port, which is formed on the face of said door that faces said drum, said discharge port being arranged along the axis of said drum and comprising a plurality of holes formed on the face of said door that faces said drum, an antistatic deionizing device being accommodated in said chamber.

2. A machine according to claim 1, wherein said holes are formed on a lateral surface of said door, except for the portion of said lateral surface of the door lying opposite with respect to an outlet of said delivery duct.

3. A machine according to claim 1, wherein said door is substantially frustum-shaped, a smaller flat face of said frustum-shaped door being directed towards said drum.

4. A machine according to claim 3, wherein the smaller flat face of the door is formed by a perforated glass plate.

5. A machine according to claim 1, wherein said container has, in lateral lower regions, two manifolds for discharging the drying air introduced in said container through said door.

6. A machine according to claim 1, wherein said container has, in upper lateral regions, outlets for the drying air fed into said container through said door.

7. A machine according to claim 1, wherein said circuit for conveying a stream of drying air comprises means for condensing the solvent carried by said drying air that leaves said container and means for heating the air before returning it into said container.

8. A machine for drying textile products, comprising a container having a drum therein that can be rotated about its own axis, said container being closed by a door on one of its sides, which is directed towards an axial end of said drum, a circuit for conveying a stream of drying air being provided, said circuit having a delivery duct leading into said container at the region of said door, wherein the machine comprises means for directing the stream of drying air, in the region where it enters said container, along a direction that is substantially parallel to the axis of said drum;

said means for directing the stream of drying air comprising a chamber formed in said door, said chamber being provided with at least one intake port, which is formed on the lateral surface of said door and faces the outlet of said delivery duct, and with at least one discharge port, which is formed on the face of said door that faces said drum, said discharge port being arranged along the axis of said drum and comprising a plurality of holes formed on the face of said door that faces said drum, an antistatic deionizing device being accommodated in said chamber.

* * * * *